US007681625B2

(12) United States Patent
Gordon et al.

(10) Patent No.: US 7,681,625 B2
(45) Date of Patent: Mar. 23, 2010

(54) FILAMENT WINDING FOR METAL MATRIX COMPOSITES

(75) Inventors: Brian L. Gordon, Wheeling, WV (US); Gregg W. Wolfe, Wheeling, WV (US)

(73) Assignee: Touchstone Research Laboratory, Ltd, Triadelphia, WV (US)

( * ) Notice: Subject to any disclaimer, the term of this patent is extended or adjusted under 35 U.S.C. 154(b) by 0 days.

(21) Appl. No.: 10/995,275

(22) Filed: Nov. 24, 2004

(65) Prior Publication Data

US 2006/0060325 A1 Mar. 23, 2006

Related U.S. Application Data

(60) Provisional application No. 60/524,624, filed on Nov. 25, 2003, provisional application No. 60/580,733, filed on Jun. 21, 2004.

(51) Int. Cl.
*B22D 19/14* (2006.01)
*B22D 11/00* (2006.01)
*B05D 1/18* (2006.01)

(52) U.S. Cl. ..... 164/461; 164/97; 427/431; 427/434.2; 427/434.6

(58) Field of Classification Search ..... 164/461, 164/419, 91, 97; 427/431, 434.2, 434.6
See application file for complete search history.

(56) References Cited

U.S. PATENT DOCUMENTS 3,103,722 A * 9/1963 Whitehurst et al. ..... 164/63
4,082,864 A * 4/1978 Kendall et al. ..... 427/255.24
4,649,060 A * 3/1987 Ishikawa et al. ..... 427/601
4,659,593 A * 4/1987 Rocher et al. ..... 427/310
4,948,406 A * 8/1990 Kornmann ..... 65/431
5,049,419 A * 9/1991 Kyono et al. ..... 427/251
5,736,199 A * 4/1998 Blucher ..... 427/430.1
6,460,597 B1 10/2002 McCullough et al.
6,524,658 B2 * 2/2003 Murofushi et al. ..... 427/431
6,629,557 B2 * 10/2003 Blucher et al. ..... 164/97

FOREIGN PATENT DOCUMENTS

EP 0765946 4/1997
GB 2222793 3/1990

* cited by examiner

*Primary Examiner*—Kevin P Kerns
(74) *Attorney, Agent, or Firm*—Philip D. Lane

(57) ABSTRACT

A wet filament winding method and apparatus for producing a consolidated metal matrix composite is described. The methods are directed to winding a softened metal infiltrated fiber bundle and layering the resulting softened metal infiltrated fiber bundle onto a rotating mandrel in a prescribed pattern on the surface of the mandrel to form a consolidated metal matrix composite. Upon cooling, the matrix metal solidifies and the resulting consolidated metal matrix composite may be removed from the mandrel. The consolidated metal matrix composites may be produced in a variety of shapes, such as cylinder, a tapered cylinder, a sphere, an ovoid, a cube, a rectangular solid, a polygonal solid, and panels.

13 Claims, 4 Drawing Sheets

FILAMENT WINDING FOR METAL MATRIX COMPOSITES

CROSS-REFERENCE TO RELATED APPLICATION

The present application claims priority to U.S. Provisional Patent Application No. 60/524,624, filed Nov. 25, 2003 and U.S. Provisional Patent Application No. 60/580,733, filed Jun. 21, 2004, each of which are specifically herein incorporated by reference in their entirety.

This invention was made with Government support under contract number DAAD19-01-2-0006 awarded by the Army Research Laboratory. The Government has certain rights in the invention.

FIELD OF THE INVENTION

The invention relates to consolidated metal matrix composites ("MMC") and methods and apparatuses for making these composites. More particularly, the invention relates to direct, filament winding of softened metal infiltrated fiber bundles for the production of consolidated metal matrix composite components.

BACKGROUND OF THE INVENTION

The next generation of high technology materials for use in aerospace and aircraft applications will need to possess high temperature capability combined with high stiffness and strength. Components fabricated from laminated metal matrix composites, as opposed to monolithic materials, provide the potential for meeting these requirements and thereby significantly advancing the designer's ability to meet the required elevated temperature and structural strength and stiffness specifications while minimizing weight.

These types of laminated metal matrix composites generally have relatively long continuous lengths of a reinforcing fibrous material, such as aluminum oxide, in a matrix of a metal such as aluminum. Continuous fiber metal matrix composite structures may be generally formed by casting the molten matrix metal into a mold containing a preform of fibers. Pressure may be used to force the matrix metal to surround the fibers. The casting molds used in this type of process are expensive, with the cost dramatically increasing as the size of the mold increases.

Fiber reinforced metal matrix composite tubes or cylinders have been prepared by winding preformed fiber reinforced aluminum tapes on a mandrel. The wound metal matrix composite tapes are consolidated with adjacent tape layers by providing a brazed layer on one side of the tape and brazing the adjacent tape layers to one another as the tape is wound on the mandrel, thereby joining and immediately consolidating the laid-down tapes to form a cylinder. The resulting composite tubes generally provide layers of the matrix metal containing the reinforcing fibers and layers of the brazing material.

SUMMARY OF THE INVENTION

The invention is generally directed to consolidated metal matrix composites and the apparatuses and methods for forming consolidated metal matrix composites by winding a softened metal infiltrated fiber bundle on a mandrel. The metal in the softened metal infiltrated fiber bundle may be partially or fully molten. The metal of overlapping softened metal infiltrated fiber bundles on the mandrel intermixes and consolidates to form a substantially void free bond between infiltrated fiber bundles. Upon cooling, the matrix metal solidifies around the infiltrated fibers thereby producing a consolidated metal matrix composite. The resulting consolidated metal matrix composite has a body portion where the matrix metal is substantially continuous with no substantial voids.

Certain embodiments of the invention include an apparatus for winding softened metal matrix infiltrated fibers where the apparatus includes an infiltration unit, a metal bath, and a rotating mandrel. The infiltration unit supplies a softened metal infiltrated fiber bundle from the metal bath to the rotating mandrel to form the consolidated metal matrix composite. In other embodiments, the infiltration unit may further include an ultrasonic waveguide. In further embodiments, at least a portion of the infiltration unit may be submerged in the metal bath. Further, the rotating mandrel may be at least partially submerged in said metal bath. The metal bath may include the matrix metal as molten metal. In other embodiments, the apparatus may include a die located between the infiltration unit and the rotating mandrel. Still further, the invention may include at least one exit roller near an exit portion of the die.

In certain embodiments, the rotating mandrel may have a cross-sectional shape, including but not limited to, a circle, an oval, an ellipse, a triangle, a rectangle, a square, a regular polygon, an irregular polygon, as well as other closed area geometric shapes. Further, the rotating mandrel may have a shaped end adapted to form a closed end on a resulting metal matrix composite cylinder. In other embodiments, the rotating mandrel may be adapted to move parallel to an axis of rotation of the rotating mandrel. Additionally, the infiltration unit may be adapted to move any direction relative to the axis of rotation of the rotating mandrel, including parallel. In still further embodiment, the infiltration unit may pivot relative to the mandrel.

In other embodiments, the infiltration unit may be eliminated and the metal matrix infiltrated fiber bundle may be supplied as a metal matrix composite tape, which is a metal infiltrated fiber bundle of defined cross-sectional shape.

The invention also includes methods for forming a consolidated metal matrix composite. In certain embodiments, a method for forming a consolidated metal matrix composite includes the steps of providing a softened metal infiltrated fiber bundle and layering the softened metal infiltrated fiber bundle onto a rotating mandrel to form a consolidated metal matrix composite. In other embodiments, the method may include the step of infiltrating a fiber bundle with a metal to form the softened metal infiltrated fiber bundle. The layering step may further include the step of layering the softened metal infiltrated fiber bundle over an end of the rotating mandrel. In yet other embodiments, the method may also include the step of generating said softened metal infiltrated fiber bundle by heating the matrix metal.

In still other embodiments, the method may also include the step of passing said softened metal infiltrated fiber bundle through a die prior to said layering step. The method may also include the step of controlling the amount of softened metal in the softened metal infiltrated fiber bundle.

The method may also include the step of positioning the softened metal infiltrated fiber bundle on the rotating mandrel where the softened metal infiltrated fiber bundle has an angle of approach to the rotating mandrel ranging from about 0 degrees to about 180 degrees. The angle of approach may be about 90 degrees. The method may also include the step of varying the angle of approach to the rotating mandrel during the layering step. The method may further include the step of laterally moving said rotating mandrel.

Still further, the invention includes a consolidated metal matrix composite having a body portion with walls defining a hole extending therethrough. The walls include a substantially uniform distribution of continuous fibers in a matrix metal throughout the volume of the walls. Further, the metal matrix is substantially continuous throughout the volume of the walls, and the walls have an uneven outer surface.

In certain embodiments, the body portion may have a shape including, but not limited to, a cylinder, a tapered cylinder, a sphere, an ovoid, a cube, a rectangular solid, a polygonal solid, a panel, and a disk. The body portion may have a cross-sectional shape including, but not limited to, a circle, an oval, an ellipsoid, a triangle, a rectangle, a square, a regular polygon, and an irregular polygon. The body portion may have a closed end.

Still further, the fibers may be positioned about parallel to one another in the body portion. In other embodiments, the continuous fibers may include fiber bundles, where at least a portion of the fiber bundles overlap at an angle. The angle may range from greater than about 0 degrees to less than about 180 degrees. The angle may further range from about 35 degrees to about 145 degrees. The fibers may include, but are not limited to, carbon fibers, boron fibers, silicon carbide fibers, aluminum oxide fibers, glass fibers, quartz fibers, basalt fibers, ceramic fibers, metal fibers, and combinations thereof. The matrix metal may include, various metals and metal alloys. Some metals may include, but are not limited to, aluminum, magnesium, titanium, silver, gold, platinum, copper, palladium, zinc, including alloys of these metal and combinations of one or more of these metals.

DETAILED DESCRIPTION OF THE INVENTION

The invention is generally directed to winding softened metal infiltrated fiber bundles on a rotating mandrel where the metal of overlapping softened metal infiltrated fiber bundles intermix and consolidate to form consolidated metal matrix composite. The softened metal is the matrix metal of the infiltrated fiber bundle that is in a molten state or at a temperature such that the matrix metal can be deformed and consolidated with adjacent metal matrix infiltrated fiber bundles with minimal force.

The resulting consolidated metal matrix composites may have a variety of cross-sectional geometric shapes. The shapes of the consolidated metal matrix composites may include, among other shapes, tubes and cylinders of various sizes and shapes. These tubes and cylinders may be used to form articles such as pipes, ducts, feed lines, pressure vessels, storage tanks, fuel tanks, golf club shanks and shafts, and other articles too numerous to mention that utilize these shapes. The invention also contemplates the manufacture of flat panel metal matrix composites. The methods and apparatuses of the invention significantly reduce the cost for the production of consolidated metal matrix composites by eliminating the need for molds and associated tooling typically used in such processes.

Figure 1:
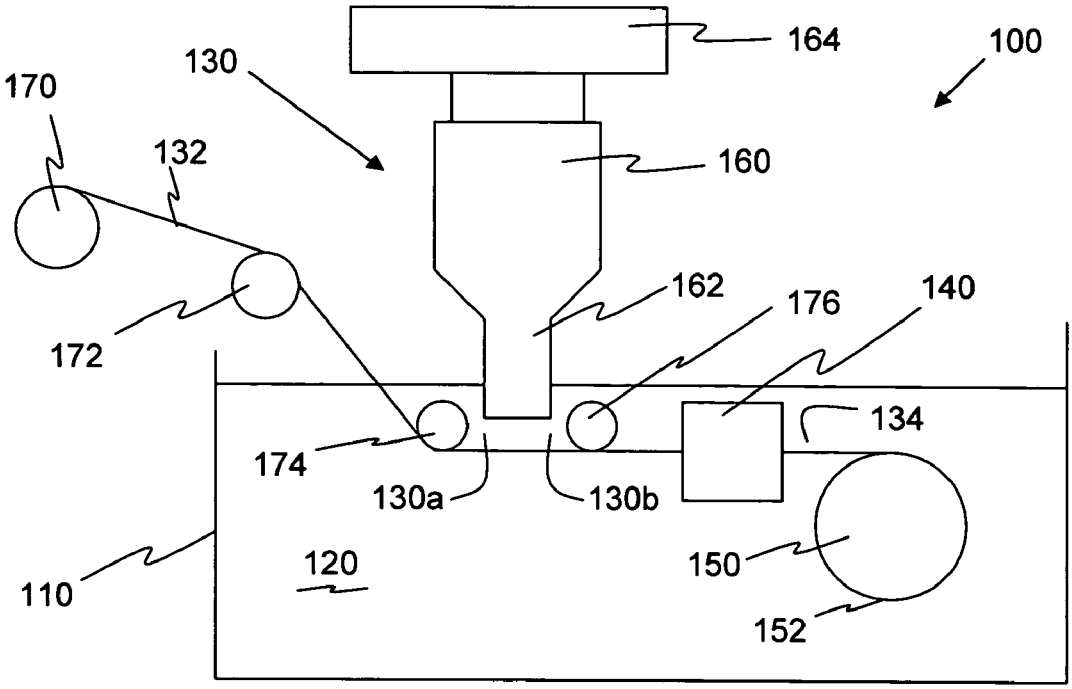
FIG. 1 is a diagrammatic view of a filament winding apparatus in accordance with an embodiment of the invention.

With reference now to FIG. 1, an illustration of a filament winding apparatus for forming a consolidated metal matrix composite in accordance with an embodiment of the invention is shown and generally depicted as reference numeral 100. The filament winding apparatus 100 generally includes a furnace 110 containing a metal bath 120, a fiber bundle infiltration unit 130 that facilitates the wetting and infiltration of the matrix metal into one or more fiber bundles 132, an optional die 140, and a rotating mandrel 150 that winds softened metal infiltrated fiber bundles 134 into the desired geometric shape. Infiltration generally refers to surrounding individual fibers in the fiber bundle with the matrix metal such that there is minimal or substantially no void space in the infiltrated fiber bundle.

Generally, any type of fiber that can withstand the process temperatures and contact with the selected softened or molten metal and maintain some characteristic of a fiber may be used. Preferably, the fiber improves the mechanical and/or physical properties of the resulting metal matrix composite above that of the matrix metal alone. Exemplary fibers, depending on the selected matrix metal, include, but are not limited to, carbon fibers, boron fibers, silicon carbide fibers, aluminum oxide fibers, glass fibers, quartz fibers, basalt fibers, ceramic fibers, metal fibers, and combinations thereof.

The metal or metal alloy used to form the matrix, i.e., the matrix metal, is not particularly limited, as long as the matrix metal is capable of infiltrating the selected fiber bundle without destroying the selected fiber under the processing conditions used to form the consolidated metal matrix composite. Possible matrix metals depending on the selected fibers include, but are not limited to, aluminum, magnesium, silver, gold, platinum, copper, palladium, zinc, including alloys and combinations thereof.

As illustrated in FIG. 1, the filament winding apparatus includes a furnace 110 that contains the metal bath 120. The metal bath 120 includes the metal that will become the matrix metal of the resulting consolidated metal matrix composite. The furnace 110 should be able to sustain a temperatures that will liquefy at least a portion of the metal used to form the metal bath 120. The size of the furnace is not critical and may vary considerably. In certain embodiments and as illustrated in FIG. 1, the size of the furnace 110 may be large enough such that a portion of the fiber infiltration unit 130 and the rotating mandrel 150 may be submerged in the metal bath 120.

The infiltration unit 130 is adapted to facilitate the wetting and infiltration of the matrix metal into one or more fiber bundles 132. The infiltration unit 130 may include a sonic processor 160, such as an ultrasonic processor. The sonic processor 160 facilitates the wetting and infiltration of the metal in the metal bath 120 into the fiber bundles 132. The sonic processor 160 may include a waveguide 162 for directing the sonic energy. The sonic processor may be one of a variety of commercially available units. The waveguide 162 should be able to withstand the conditions of the metal bath 120. The waveguide 162 may be fabricated from a number of materials such as titanium, niobium, and alloys thereof. The frequency range and power output may be variably adjusted depending on factors such as the matrix metal, the types of fibers to be infiltrated, and the size, shape, and number of fibers and fiber bundles. In certain embodiments, the waveguide 162 may be surrounded by a double walled cooling chamber that allows continuous gas purge through the chamber. The sonic processor 160 is preferably connected to a positioning device 164 that provides for adjusting the position of the waveguide 162. The positioning device 164 allows for the raising and lowering the waveguide 162 such the distance between the waveguide 162 and the fiber bundles 132 may be varied. In certain embodiments, a portion of the waveguide 162 may be positioned near or below the surface of the metal bath 120.

The fibers or fiber bundles 132 should be positioned near the waveguide 162 such that the fibers are caused to be infiltrated with the metal from the metal bath 120. If the fibers are not positioned close enough to the waveguide, the fibers may not become fully infiltrated with the metal from the metal bath.

To assist in the handling and positioning of the fiber bundles 132 during the infiltration process, a series of rollers may be provided to orient and direct the fiber bundles into the metal bath and pass the fiber bundles near or across the waveguide 162. In the embodiment shown in FIG. 1, an initial fiber guide 170 may be used to receive the fiber bundles 132 from a fiber supply source and initially orient the fibers or fiber bundles. A fiber orienting guide 172 may be provided to further orient and position the fiber bundles. In certain embodiments, the fiber orienting guide 172 may be a roller that contains a series of grooves around the circumference of the roller where the grooves are sized to receive and position the fibers or fiber bundles. The grooves help maintain the position of the fibers on the fiber orienting roller such that the fibers do not move laterally across the fiber orienting roller during operation. Further, one or more infiltration guides may be used to direct the fiber bundles in the metal bath and near or across the waveguide. A first infiltration guide 174 may be positioned near the input side 130*a* of the infiltration unit. A second infiltration guide 176 may be positioned near the output side 130*b* of the infiltration unit such that the waveguide 162 is positioned between the first infiltration guide 174 and the second infiltration guide 176. The initial fiber guide 170, the fiber orienting guide 172, and the infiltration guides 174 and 176 may be rollers, cylinders, curved surface or other similar guides. Preferably, the guides are configured such that the surface of the guide facilitates the movement of the fibers across the guide and reduces the breaking of the fibers as fibers move across the guides.

As illustrated in FIG. 1, an optional die 140 may be positioned near an output side 130*b* of the infiltration unit 130. The die 140 may be used to shape the infiltrated fiber bundles and may control the amount of the matrix metal accompanying the fiber bundle. The location of the die 140 may vary depending on the application. The die may be located above, partially submerged, or completely submerged in the metal bath 120. The die 140 may be connected to a die positioning device that can adjust the position of the die vertically and horizontally.

Figure 2:
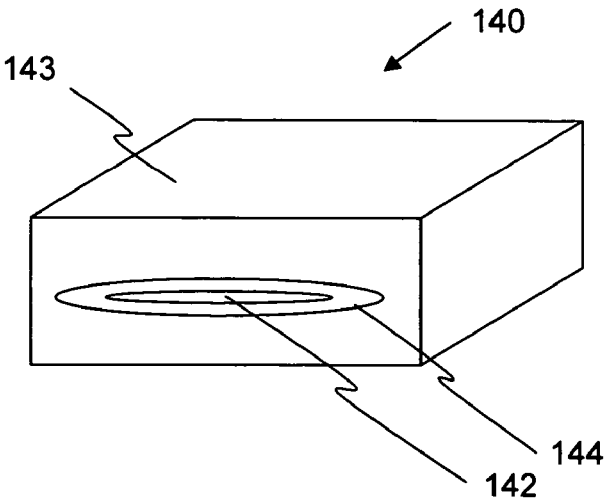
FIG. 2 is a perspective view of a die in accordance with an embodiment of the invention.

Turning now to FIG. 2, an embodiment of a die 140 is shown in more detail. In this embodiment, the die 140 includes a die opening 142 extending through the body 143 of the die which shapes the infiltrated fiber bundles into the desired shape. The shape of the die opening 142 may have any variety of geometric shapes, including, but not limited to, oval circular, elliptical, triangular, polygonal, irregular polygonal, or other closed area geometric shape. To facilitate in the handling of the fiber bundles, the die opening has relieved or curved edges 144. Preferably the edges of the die opening are radiused. The radius of the edges is not particularly limited. Preferably, the radius of the edges is sufficient to reduce the likelihood of the fibers breaking due to the contact with the die opening.

Figure 3:
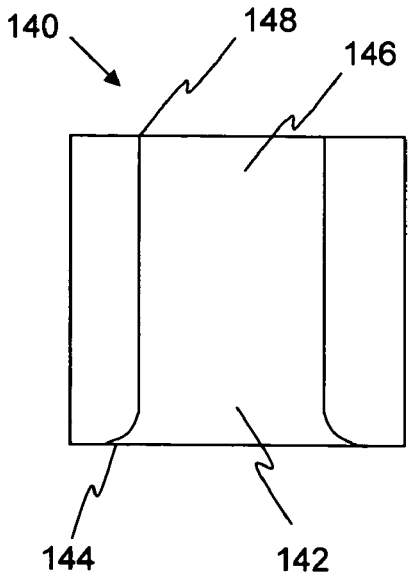
FIG. 3 is a cross-sectional view of the die in FIG. 2.

FIG. 3 shows a horizontal cross-section of the die 140 shown in FIG. 2. The die 140 may include a die opening 142 with radiused die edges 144, followed by a land portion 146 that shapes the fiber bundles and relatively controls the amount of matrix metal accompanying the fiber bundle. The land portion 146 of the die 140 may be used to control the size and fiber volume fraction of the fiber bundle in the metal matrix composite. The edges of the die exit 148 may optionally be radiused. The die opening 142 and land portion 146 may be grooves formed into mating portions of material used to form the die 140.

The die should be constructed of a material that can maintain its shape and structural integrity when exposed to the metal bath and infiltrated fiber bundles. For many applications, the die may be fabricated from graphite, metal, or suitable ceramic or refractory materials.

Figure 4:
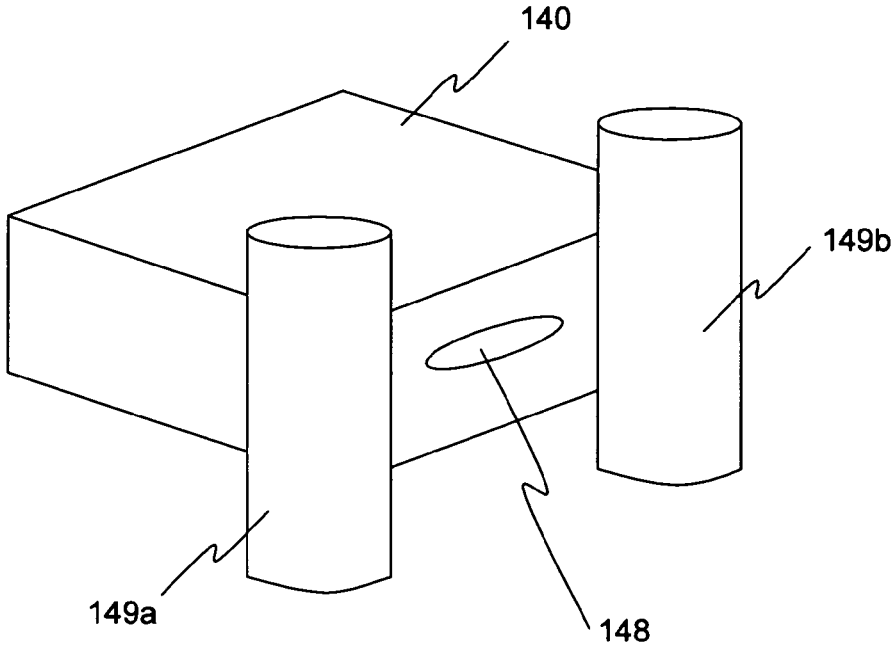
FIG. 4 is a perspective view of an exit portion of a die in accordance with an embodiment of the invention.

Referring now to FIG. 4, an exit portion of a die 140 is illustrated. In this embodiment, the die exit 148 is near one or more die exit guides or rollers. In the embodiment shown in FIG. 4, vertical exit rollers 149*a* and 149*b* are provided on each side of the die exit 148. The exit rollers 149*a* and 149*b* assist in the transfer of the infiltrated fiber bundles from the die 140 to a rotating mandrel. Similarly, horizontal exit rollers may also be used alone or in combination with the vertical exit rollers. The angle and orientation of the exit rollers may vary depending on the shape, position, and direction of movement of the rotating mandrel. The exit rollers should be made of a material that can maintain their shape and structural integrity when exposed to the conditions of the metal bath and infiltrated fiber bundles. As with the die above, for many applications, the rollers may be fabricated from graphite, metal, or suitable ceramic or refractory materials.

With reference now to FIG. 1 a rotating mandrel 150 may be provided near the output side 130*b* of the infiltration unit 130 and positioned to receive the softened metal infiltrated fiber bundle 134 from the infiltration unit 130. The rotating mandrel 150 may be positioned above, partially submerged or completely submerged in the metal bath 120. For positioning the rotating mandrel 150, the rotating mandrel may be connected to a rotating mandrel positioning device. In certain embodiments, the rotating mandrel 150 is positioned such that the axis of rotation for the rotating mandrel 150 is approximately normal to the principle axis of the infiltrated fiber bundle exiting the fiber infiltration unit 130 or die 140. The rotating mandrel 150 may be moved in a direction relatively parallel to the axis of rotation by using any well known mechanism such as a linear motion motor to provide for control of the layering of the metal matrix composite. Optionally, the die 140 and infiltration unit 130 may be moved on an axis parallel to the axis of rotation of the rotating mandrel.

The mandrel 150 may have variety of cross-sectional shapes, including, but not limited to circular, oval, elliptical, square, triangular, rectangular, regular polygonal, irregular polygonal, planar and other similar cross-sections. Optionally, one end of the mandrel 152 may have shaped surface for forming a closed end of the consolidated metal matrix composite during the winding process. The mandrel 150 may be fabricated from any suitable material that is not significantly wet by the matrix metal and which is substantially chemically inert to the matrix metal and fiber bundle. The mandrel is preferably capable of tolerating the operating temperatures of the metal bath, with a coefficient of thermal expansion greater than or equal to that of the resulting consolidated metal matrix composite. The mandrel should have sufficient strength to support the layered or positioned metal infiltrated fiber bundles and the resultant consolidated metal matrix composite. For many applications, the mandrel may be made of graphite, metal, or suitable ceramic or refractory materials. The mandrel is preferably constructed to allow for removal of the consolidated metal matrix composite, for example, by slotting, disassembling, collapsing, machining away, or dissolving the mandrel.

Figure 5:
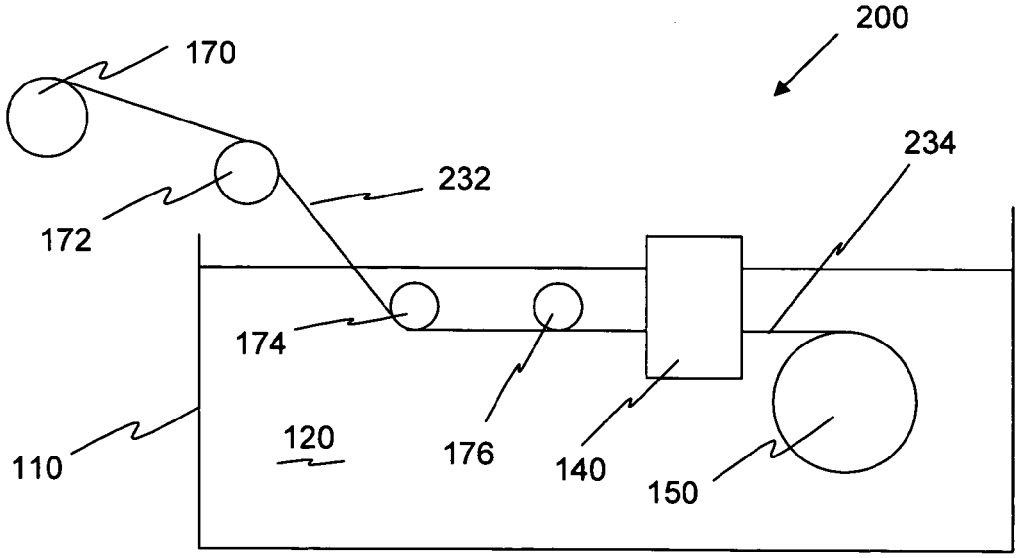
FIG. 5 is a diagrammatic view of another embodiment of a filament winding apparatus.

With reference now to FIG. 5, an alternative embodiment for a filament winding apparatus is illustrated and given the reference numeral 200. In this embodiment, the infiltration unit may be eliminated by drawing pre-infiltrated metal matrix composite tapes or wires 232 through the metal bath 120 and optional die 140 followed by winding on the rotating mandrel 150. By drawing the pre-infiltrated metal matrix composite 232 through the metal bath 120, the matrix metal is softened to form a softened metal infiltrated fiber bundle 234 to allow for consolidation on the rotating mandrel 150.

For illustrative purposes and not to limit the invention, a method for forming a consolidated metal matrix composite by filament winding in accordance with an embodiment of the invention will be described. The method may generally include winding a softened infiltrated fiber bundle onto a rotating mandrel where the matrix metal is softened and in a state such that upon winding, matrix metal in adjacent infiltrated fiber bundles intermix, thereby forming a consolidated metal matrix composite substantially free of voids between overlapping infiltrated fiber bundles. Upon cooling, the matrix metal solidifies and the resulting consolidated metal matrix composite may be removed from the mandrel.

With reference now to FIG. 1, the fiber bundle 132 may be continuously fed to the infiltration unit 130 and immersed into the metal bath 120. The metal may be degassed during and/or prior to infiltration to reduce the amount of gas, such as hydrogen, in the softened metal. Where the fibers enter or exit the metal bath, it may be advantageous to provide an inert gas such as nitrogen or argon around the point of entry to minimize the formation of a metal oxide film on the surface of the metal bath. As the fibers enter or exit the bath this film may get picked up by the fibers producing defects in the infiltrated fiber bundle or consolidated metal matrix composite.

As the fiber bundle passes through the infiltration unit 130, the fibers pass near the waveguide 162. The waveguide 162 directs ultrasonic energy through the fibers and the metal surrounding the fibers. The metal wets the fibers so that each individual fiber of the fiber bundle is substantially surrounded or encapsulated by the metal, preferably leaving no or minimal void spaces and forms a softened metal matrix infiltrated fiber bundle 134.

The softened metal matrix infiltrated fiber bundle 134 may then be pulled through the die 140 to shape the infiltrated fiber bundle and control the fiber volume fraction of the infiltrated fiber bundle. While the die 140 provides certain advantages discussed above, the die 140 may be omitted.

To pull the fibers through the apparatus 100, the fiber bundles may be affixed to the rotating mandrel 150. Upon rotation of the mandrel 150, the infiltrated fiber bundle 134 are pulled through the die 140 or pulled from the infiltration unit 130 and placed onto the rotating mandrel 150 while metal in the infiltrated fiber bundle 134 remains in a softened condition. The soften condition of the metal may be metal in a fully or partially molten state. The rotation of the mandrel 150 controls the rate at which the infiltrated fiber bundles 134 are pulled through the apparatus 100. The angle of approach of the infiltrated fiber bundles to the axis of rotation of the mandrel may range from greater than about 0 degrees to less than about 180 degrees. This may be accomplished by pivoting the infiltration unit 130 and optional die 140 relative to the axis of rotation of the mandrel 150. Alternatively, the mandrel 150 may be pivoted separately or in combination with the infiltration unit 130 and optional die 140. The angle of approach may be varied without pivoting the infiltration unit 130 or rotating mandrel 150 by controlling the rotation rate of the mandrel 150 and the rate at which the mandrel 150 moves along the axis of rotation. As shown in FIG. 4, rollers 149*a* and 149*b* on each side of the die exit 148 are advantageous as the angle of approach to the rotating mandrel 150 moves from 90 degrees. Rollers help prevent the fibers from rubbing against the edges of the die exit 148 and thus reduce the likelihood that fibers will break as they are being wound onto the rotating mandrel 150.

As the mandrel 150 rotates, the softened metal infiltrated fiber bundle may be layered onto the mandrel in prescribed patterns with a sufficient number of layers to cover the surface of the mandrel. The pattern in which the infiltrated fiber bundles are layered may vary widely and may be controlled through movement of the rotating mandrel, as well as by pivoting the infiltration unit and die separately or in conjunction with pivoting the mandrel. In certain embodiments, the rotating mandrel is moved parallel to the axis of rotation of the mandrel to provide for control of the layering of the infiltrated fiber bundles on the mandrel. The distance and speed in which the rotating mandrel is moved along the axis of rotation relative to the rotational speed of the mandrel during the layering of the infiltrated fiber bundles can determine the orientation of the fibers in the resulting consolidated metal matrix composite. The orientation of the layering of the infiltrated fiber bundles includes, but is not limited to circular or hoops about the axis of rotation or helical patterns that result in a woven appearance.

Alternatively, rather then moving the rotating mandrel 150 parallel to the axis of rotation, the die 140 and infiltration unit 130 may be moved and pivoted to vary the angle of approach of the infiltrated fiber bundle. The rotating mandrel dictates the rate at which the fibers are pulled from the fiber supply source.

Once the softened metal matrix infiltrated fiber bundles are wound on the rotating mandrel 150, the matrix metal may be allowed to harden, such as by cooling, on the mandrel thereby producing a consolidated metal matrix composite. The consolidated metal matrix composite may then be removed from the mandrel. By allowing the matrix metal to harden prior to removing the consolidated metal matrix composite ensures that the desired cross-sectional shape is maintained.

Preferably, the formation of metal oxides on the surface of the softened matrix metal is minimized between and during infiltration and consolidation. Such oxides may inhibit adequate bonding between successive layers of the matrix metal infiltrated fiber bundle on the mandrel. Oxide development may be prevented, or its formation inhibited, by performing the above operations in an environment that essentially inert to the formation of oxides. Such an environment may be provided by performing the operations described above at least partially immersed in a bath of the molten matrix metal. Use of a molten matrix metal bath may lead to the development of dross on the bath surface. Care should be exercised that dross does not become entrapped or incorporated into or on the infiltrated fiber bundle. Alternatively, the operations described above may be completely or partially performed in a heated environment such as provided by an oven, a furnace, or other heating apparatus having an atmosphere that is essentially inert, or non-reactive, to the formation of oxides.

Without intending to limit the scope of the invention, embodiments of the produced consolidated metal matrix composites will generally be described. The consolidated metal matrix composites may be formed in a variety of cross-sectional shapes such as circular, oval, elliptical, square, triangular, rectangular, regular polygonal, irregular polygonal, planar and other similar cross-sectional shapes depending on the shape of the rotating mandrel. Further, the consolidated metal matrix composites may have shapes including, but not limited to, a cylinder, a tapered cylinder, a sphere, an ovoid, a cube, a rectangular solid, a polygonal solid, a panel, and a disk Generally, the matrix metal in the consolidated metal matrix composite is consolidated and integrally formed throughout the shape of the consolidated metal matrix composite such that there are no voids or only minimal voids or gaps between adjacent infiltrated fiber bundles. While the resulting consolidated metal matrix composite may have a variety of cross-sectional shapes, a consolidated metal matrix composite having a circular cross-section will be described.

Figure 6:
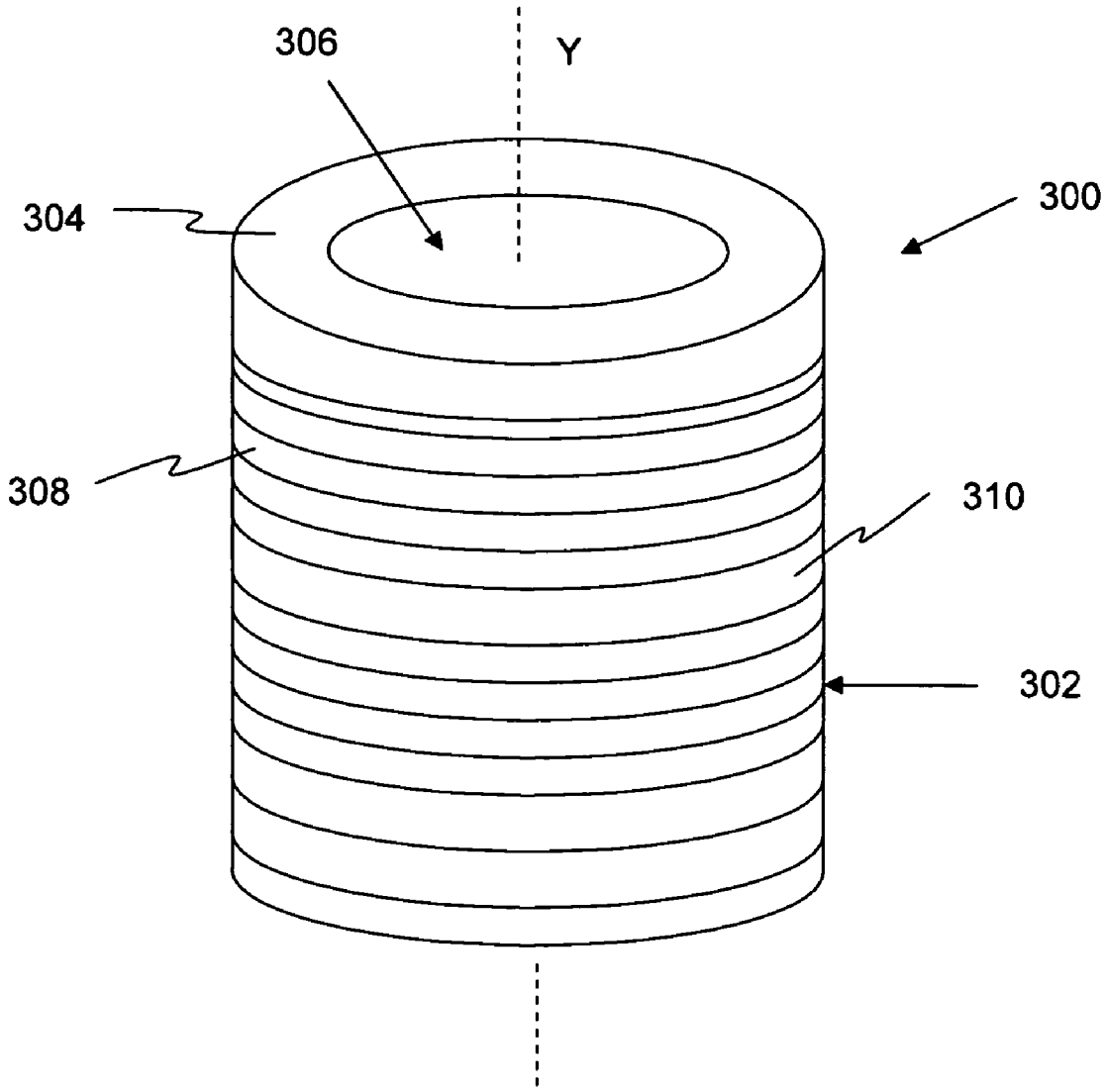
FIG. 6 a perspective view of a consolidated metal matrix composite in accordance with an embodiment of the invention.

With reference to FIG. 6, there is shown a consolidated metal matrix composite 300 in accordance with an embodiment of the invention which is in the form of a cylinder. The consolidated metal matrix composite 300 includes a body portion 302 having walls 304 defining a hole 306 extending therethrough. The walls 304 have a substantially uniform distribution of continuous fibers in a matrix metal throughout the volume of the walls. Further, the metal matrix is substantially continuous throughout the volume of the walls 304. Because the fiber bundles have been wound on the mandrel the outer surface 308 of the wall 304 is generally slightly uneven with infiltrated fiber bundles 310 typically being visible on the outer surface 308 of the wall 304. In the embodiment illustrated in FIG. 6, the orientation of the infiltrated fiber bundles 310 in the consolidated metal matrix composite 300 is generally form adjacent hoops around the axis of rotation Y. The orientation of the fiber bundles can be dictated by the movement of the rotating mandrel relative to the rotational speed of the mandrel. If the movement of the rotating mandrel is slow relative to the rotational speed of the mandrel, the infiltrated fiber bundles will be placed next to one another forming a circular or hoop formation of fibers about the axis of rotation Y of the cylinder. The angle of approach that softened metal matrix infiltrated fiber bundles are placed on the mandrel is an angle that is about 90 degrees to the rotational axis. The infiltrated fiber bundles 310 are generally parallel to one another within the metal matrix composite. The thickness of the walls 310 of the consolidated metal matrix composite increases as the number of layers of infiltrated fiber bundles that are placed about the rotating mandrel increases.

Figure 7:
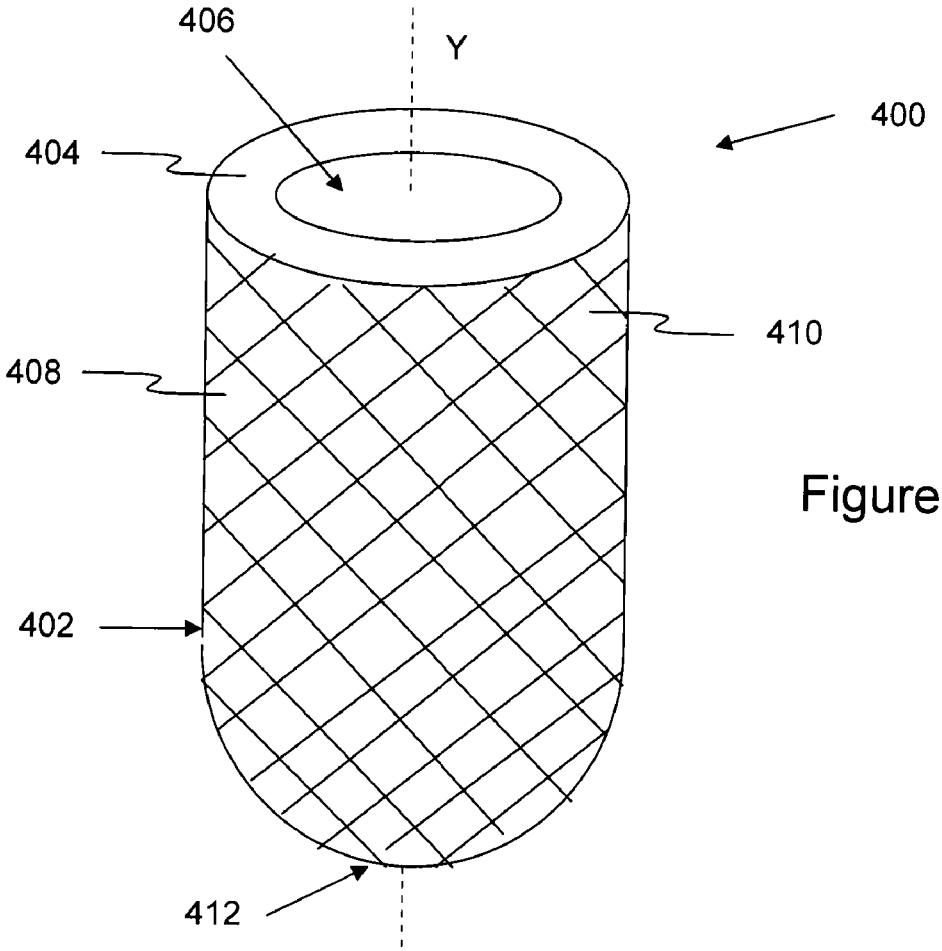
FIG. 7 is a perspective view of a consolidated metal matrix composite in accordance with another embodiment of the invention.

With reference now to FIG. 7, another embodiment of a consolidated metal matrix composite 400 is illustrated in the form of a cylinder having a closed end. The consolidated metal matrix composite 400 includes a body portion 402 having a wall 404 defining a hole 406. In this embodiment, a majority of the infiltrated fiber bundles 410 overlap other fibers at an angle creating a helical or woven pattern visible on the outer surface 408 of the wall 404. This pattern is created by varying the angle of approach for the softened metal matrix infiltrated fiber bundles to the rotating mandrel from greater than about 0 degrees to less than about 180 degrees. This can be accomplished by increasing the speed at which the rotating mandrel is moved parallel to the axis of rotation Y or by pivoting the infiltration unit and die separately or in combination with pivoting the mandrel. In this embodiment, the infiltrated fiber bundles are wound around the rotating mandrel and form a woven type pattern where groups of fibers are at angles to one another. The infiltrated fiber bundles in the consolidated metal matrix composite may be at angles ranging from about 10 degrees to about 90 degrees to one another. In embodiments where a mandrel with a shaped end is used during the winding process, a closed end 412 to the metal matrix composite 400 may be formed.

Figure 8:
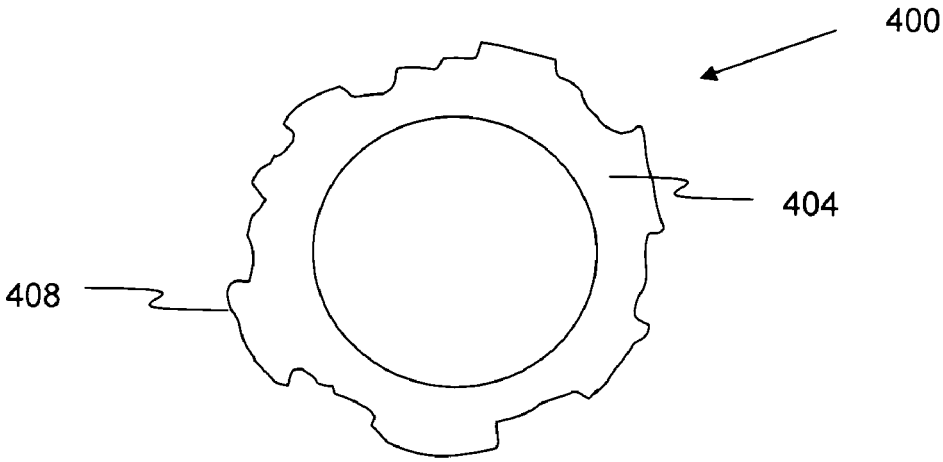
FIG. 8 is a cross-sectional view of the consolidated metal matrix composite shown in FIG. 7.

With reference to FIG. 8, a cross-section view of the consolidated metal matrix composite of FIG. 8. As can be seen the outer surface 408 of the wall 404 is generally uneven due with the wall thickness varying at different regions due to the helical layering of the metal infiltrated fiber bundles.

The properties of the resulting metal matrix composites will vary widely depending on such factors as the matrix metal, the fibers, the number of layers used to form the composite, and the orientation of the fibers within the composite. Generally, the consolidated metal matrix composites can hold gas and liquid pressures when sealed at both ends. The pressure that the composite can withstand will depend upon the above mentioned factors.

The following examples are provided to illustrate certain embodiments of the invention and are not intended to limit the scope of the invention.

Example 1

A filament wound metal matrix composite cylinder was produced by feeding a bundle of six tows of 10,000 denier alumina fibers (available from the 3M Company under the trade name Nextel® 610) from a creel with tensioned spools through a set of eyelet guides and positioning rollers. The bundle was directed into a bath of molten aluminum, which was maintained at approximately 1350° F. The molten aluminum was prepared by melting aluminum (99.99% Al). Molten aluminum was infiltrated into the fiber bundle by means of ultrasonic vibrations. The ultrasonic vibrations were provided by a waveguide connected to an ultrasonic processor. The waveguide included a 1-inch diameter Ti-6Al-4V (wt %) extender and a pure Nb tip. The Nb waveguide tip was positioned within 0.050" of the fiber bundle and operated at 20 kHz. The leading end of the fiber bundle was connected to a mandrel which was connected to a motor via a cross-link to control the rotation and a manual screw drive to control the lateral traverse. The fiber bundle was pulled through the molten aluminum and past the infiltration unit by the rotation of the mandrel. Using this set-up, several cylinders were produced with circumferential, or hoop, wraps with the position of the wrap controlled by manually turning a knob connected to the screw drive mechanism. In addition, one cylinder was produced that had a step-down taper from a 4" diameter on the large end to a 3" diameter on the small end.

Example 2

A filament wound metal matrix composite cylinder was produced by feeding a bundle of six tows of 10,000 denier alumina fibers (available from the 3M Company under the trade name Nextel 610) from a creel with tensioned spools through a series of tensioning rollers, eyelet guides, and positioning rollers. The bundle was directed into a bath of molten aluminum, which was maintained at approximately 1350° F. The molten aluminum was prepared by melting 99.99% aluminum. Molten aluminum was infiltrated into the fiber bundle by means of ultrasonic vibrations. The ultrasonic vibrations were provided by a waveguide connected to an ultrasonic processor. The waveguide consisted of a 1-inch diameter Ti-6Al-4V (%) extender and a pure Nb tip. The Nb waveguide tip was positioned within 0.050" of the fiber bundle and operated at 20 kHz. The leading end of the fiber bundle was connected to a mandrel that is connected to a filament winder (McClean-Anderson, Schofield, Wis.) and the fiber bundle was pulled through the molten aluminum by means of rotation of the mandrel. The mandrel, made from a medium grain extruded graphite rod, was mostly submerged in the molten aluminum and was connected to the spindle drive of the filament winder by means of a chain drive. The chain drive consisted of a sprocket mounted onto a keyed shaft that was loaded into the head and tail stocks of the filament winder and a second sprocket mounted to the mandrel drive shaft. The mandrel was also connected to the carriage of the filament winder and the traverse motion was obtained by allowing the first sprocket mentioned above to slide of the keyed shaft by mounting the sprocket onto a bushing and supporting the mandrel holder with a series of pillow block supports. Since the original controlling motions of the filament winder were preserved, the machine could be programmed to lay the fiber bundle onto the mandrel in prescribed patterns. Using this method, cylinders have been produced with the properties listed in Table I.

TABLE I

| Lay-up | Inner Diameter (in) | Length (in) | Wall Thickness (in) | Fiber Volume Fraction |
|---|---|---|---|---|
| $[90]_4$ | 2 | 4.5 | 0.035 | ~0.40 |
| $[90]_4$ | 4 | 6.4 | 0.055 | 0.45 |
| [90/±67.5] | 4 | 8.5 | 0.086 | |
| [90/±45] | 4 | 8.0 | 0.090 | |

The lay-up indicated in Table I is a short-hand description of the ply angles contained within the resulting composite. For example, the $[90]_4$ designation means that four 90°, or hoop plies, have been placed onto the mandrel to form this composite. Likewise, the [90/±67.5] designation means that one hoop ply and two helical layers, consisting of fibers at an angle of +67.5 degrees and −67.5 degrees with respect to the axis of rotation of the mandrel, have been placed onto the mandrel to form this composite.

The above examples are not to be considered limiting and are only illustrative of a few of the many embodiments of the present invention. The present invention may be varied in many ways without departing form the scope of the invention and is only limited by the following claims.

What is claimed is:

1. A method for forming a consolidated metal matrix composite, comprising the steps of:

providing a softened metal infiltrated fiber bundle; and overlapping said softened metal infiltrated fiber bundle onto a rotating mandrel wherein metal of said overlapping softened metal infiltrated fiber bundle intermix and consolidate with adjacent metal infiltrated fiber bundles to provide a consolidated metal matrix composite, and wherein a portion of said rotating mandrel is submerged in a metal bath during the overlapping step.

2. The method of claim 1, further comprising the step of infiltrating a fiber bundle with a metal to form said softened metal infiltrated fiber bundle.

3. The method of claim 1, further comprising the step of passing said softened metal infiltrated fiber bundle through a die prior to said layering step.

4. The method of claim 1, further comprising the step of generating said softened metal infiltrated fiber bundle by heating.

5. The method of claim 1, further comprising the step of controlling the amount of softened metal in said softened metal infiltrated fiber bundle.

6. The method of claim 1, further comprising the step of positioning the softened metal infiltrated fiber bundle on said rotating mandrel wherein the softened metal infiltrated fiber bundle has an angle of approach to an axis of rotation of the rotating mandrel ranging from about 0 degrees to about 180 degrees.

7. The method of claim 6, wherein the angle of approach is about 90 degrees.

8. The method of claim 6, further comprising the step of varying the angle of approach to said rotating mandrel during said layering.

9. The method of claim 1, further comprising the step of laterally moving said rotating mandrel.

10. The method of claim 1, wherein said overlapping step further comprises the step of layering said softened metal infiltrated fiber bundle over an end of said rotating mandrel.

11. The method of claim 1, wherein said rotating mandrel is submerged in a metal bath.

12. A method for forming a consolidated metal matrix composite, comprising the steps of:

providing a softened metal infiltrated fiber bundle; and winding said softened metal infiltrated fiber bundle onto a rotating mandrel and providing layers of overlapping softened metal infiltrated fiber bundles while metal of said softened metal infiltrated fiber bundles is in a partially molten state such that the metal of overlapping softened metal infiltrated fiber bundles intermix, consolidate, and provide a consolidated metal matrix composite on the mandrel, wherein a portion of said rotating mandrel is submerged in a metal bath, during the winding step.

13. The method of claim 12, wherein said rotating mandrel is submerged in a metal bath.

* * * * *